US006793046B2

(12) United States Patent
Petzl et al.

(10) Patent No.: US 6,793,046 B2
(45) Date of Patent: Sep. 21, 2004

(54) FALL ARREST DEVICE FOR A FIXED ROPE

(75) Inventors: Paul Petzl, Barraux (FR); Alain Maurice, Saint Hilaire de Touvet (FR); Christian Broquerie, Fontaine (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/614,515

(22) Filed: Jul. 8, 2003

(65) Prior Publication Data

US 2004/0020727 A1 Feb. 5, 2004

(30) Foreign Application Priority Data

Jul. 12, 2002 (FR) ..... 02 08865

(51) Int. Cl.[7] ..... B65H 59/16
(52) U.S. Cl. ..... 188/188; 188/65.1
(58) Field of Search ..... 188/188, 65.1

(56) References Cited

U.S. PATENT DOCUMENTS 2,080,700 A * 5/1937 Dale ..... 24/134 R
3,811,155 A * 5/1974 Stafford ..... 24/115 G
3,852,943 A * 12/1974 Healy ..... 24/134 R
4,077,094 A * 3/1978 Swager ..... 24/134 R
4,542,884 A * 9/1985 Dodge, Jr. ..... 254/391
4,923,037 A 5/1990 Stephenson et al.
4,941,548 A * 7/1990 Blanchard ..... 182/234
5,156,240 A * 10/1992 Ostrobrod ..... 188/65.1
5,323,873 A 6/1994 Pelofi
5,855,251 A * 1/1999 Deuer ..... 182/5
6,056,086 A 5/2000 Gortan et al.

FOREIGN PATENT DOCUMENTS

GB A 1131310 10/1968

* cited by examiner

*Primary Examiner*—Benjamin A Pezzlo
(74) *Attorney, Agent, or Firm*—Oliff & Berridge, PLC

(57) ABSTRACT

A follower fall arrest device used with a fixed safety rope is equipped with a securing system comprising a support arm articulated on a first spindle between an active locking and an inactive unlocking position, a roller in the form of a cylindrical wheel mounted rotating free on a second spindle securedly attached to the support arm, and a centrifugal clutch mechanism arranged between a drive member of the roller and the support arm so as to occupy a disengaged position or an engaged position. The peripheral surface of the roller is equipped with a plurality of studs presenting a predetermined angle of incline so as to cause rotation of the roller in the descending direction, and sliding on the rope in the ascending direction. The body comprises a straight U-shaped channel for passage of the rope, said channel having holes for passage of the attachment means.

7 Claims, 15 Drawing Sheets

FALL ARREST DEVICE FOR A FIXED ROPE

BACKGROUND OF THE INVENTION

The invention relates to a follower fall arrest device used with a fixed safety rope, and comprising:

a body equipped with a securing system arranged to occupy either an active locking position in case of a fall or an inactive unlocking position enabling the user to progress along the rope in the ascending direction, or in the opposite direction when performing a controlled descent, said securing system comprising a support arm articulated on a first spindle of the body, a roller in the form of a cylindrical wheel mounted rotating free on a second spindle securedly attached to the support arm, and a centrifugal clutch mechanism arranged between a drive member of the roller and the support arm so as to occupy a disengaged position or an engaged position, and attachment means for connecting the body to a safety harness worn by the user.

STATE OF THE ART

In normal use for ascending or descending, fall arrest devices follow the progression of the person along the rope without causing any seizure. The person is free to move without any manual unlocking action on the fall arrest device. Locking only takes place in case of a fall.

The securing system of known fall arrest devices generally comprises a pivoting lever having an attachment ring at one of the ends thereof for connection to a harness, and a cam for jamming the rope at the opposite end thereof. Such an arrangement acts as a jamming cleat, which is liable to prevent locking if the user grabs the lever in case of a fall.

The document WO 00/24471 relates to a two-way locking device for a fall arrest device comprising a locking member equipped with two cams actuated in independent manner by a common disabling member in reaction to a sudden change of weight. Locking of each of the cams depends on the angle of incline of the rope with respect to the frame of the device.

The document U.S. Pat. No. 4,923,037 describes a fall arrest device having a securing system composed of an articulated support arm which is equipped with a cylindrical wheel mounted with free pivoting and a centrifugal clutch mechanism arranged as a pawl. The periphery of the wheel comprises a series of teeth forming a sprocket causing rotation of the wheel by friction effect with the rope. The radial direction of the teeth does not enable optimum operation of the fall arrest device to be obtained. Moreover, to insert the vertical lifeline in the fall arrest device, it is necessary to make use of an articulated U-shaped angle bracket and to make it pivot outwards, which complicates operations.

OBJECT OF THE INVENTION

The object of the invention is to provide a fall arrest device for a fixed rope enabling maximum safety to be achieved for the user in case of a fall, regardless of the angle of incline of the rope or of a handling error of the equipment.

The fall arrest device according to the invention is characterized in that the peripheral surface of the roller is equipped with a plurality of studs arranged to cause rotation of the roller in the descending direction, and sliding on the rope in the ascending direction, and that the body comprises a straight U-shaped channel for passage of the rope, said channel having holes for passage of the attachment means.

In normal use for ascending or descending, the clutch mechanism is in the disengaged position, and the fall arrest device follows the progression of the person along the rope without any manual unlocking action of the securing system. Locking takes place automatically in case of a fall even if the user doesn't seize the device. In this case, the clutch mechanism is in the engaged position resulting in a strong pressure being exerted by the roller against the rope.

According to a preferred embodiment, the clutch mechanism is arranged inside the roller and comprises at least one flyweight movable by centrifugal effect along a ramp according to the speed or the acceleration of the drive member of the roller. The flyweight is associated with a return spring urging the clutch mechanism to the disengaged position, the coupling threshold being reached when the centrifugal force is greater than the return force of the spring.

It is naturally possible to use any other type of engagement device designed to lock the roller on the support arm at a predetermined speed.

Other features can be used either separately or in combination:

the flyweight is cylindrical in shape and cooperates in the engaged position with a cylindrical rim of the support arm;

the attachment means are formed by a karabiner passing through aligned holes of the body of the fall arrest device;

the support arm is equipped with safety means designed to limit the pivoting travel of said arm in the inactive unlocking position and to prevent the karabiner from being fitted before the rope has been inserted in the channel;

the safety means comprise a stop securedly attached to the support arm and having one end equipped with a protuberance;

the safety means comprise a flap pivotally mounted on a spindle and comprising an oblong opening inside which an operating lever securedly attached to the support arm moves, and a wing designed to press the rope against the bottom of the channel.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF TWO PREFERRED EMBODIMENTS

Figure 1:
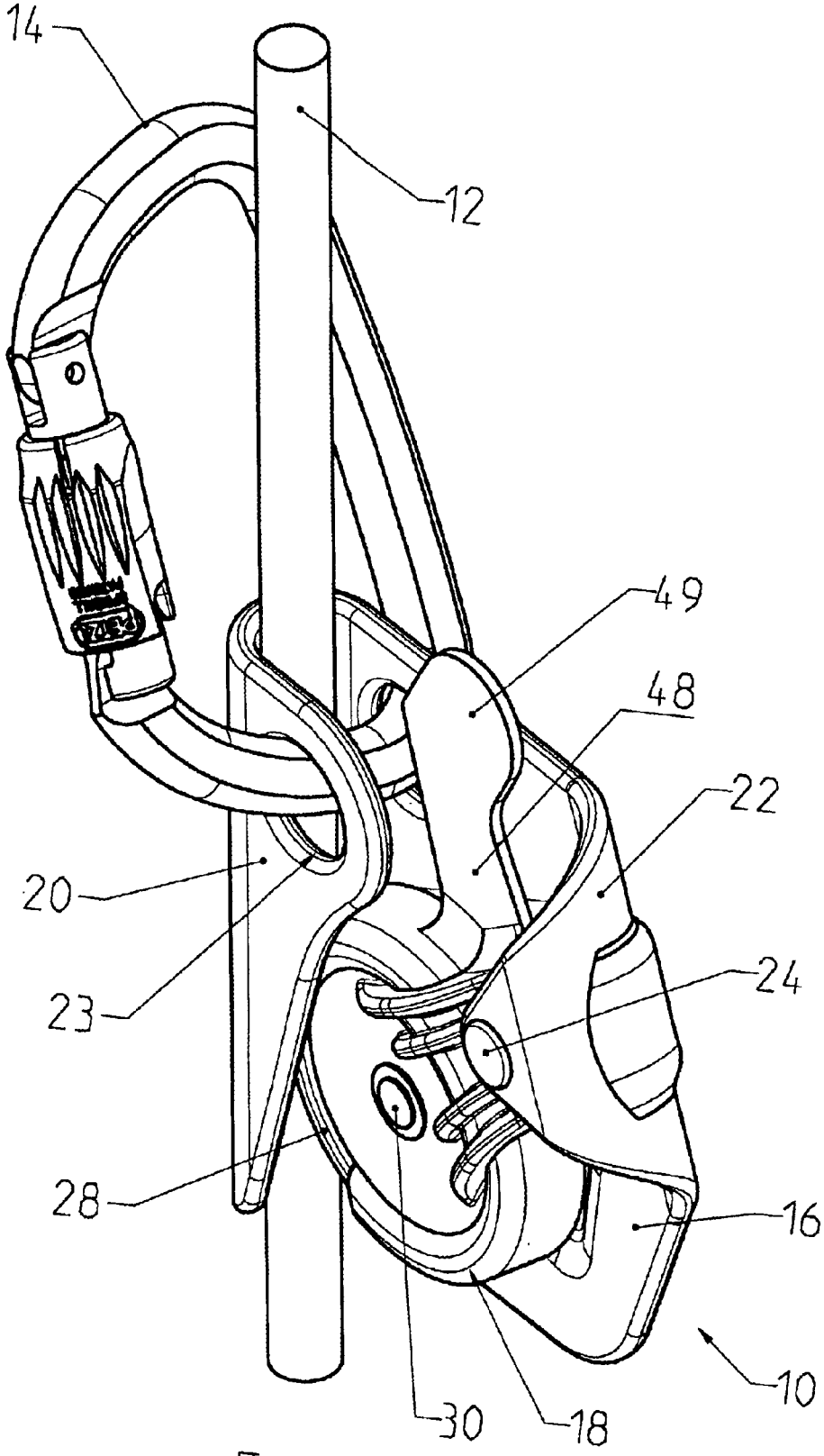
FIG. 1 is perspective view of the fall arrest device according to the invention, which is fitted on a belaying rope after an attachment karabiner has been fitted.
Figure 2:
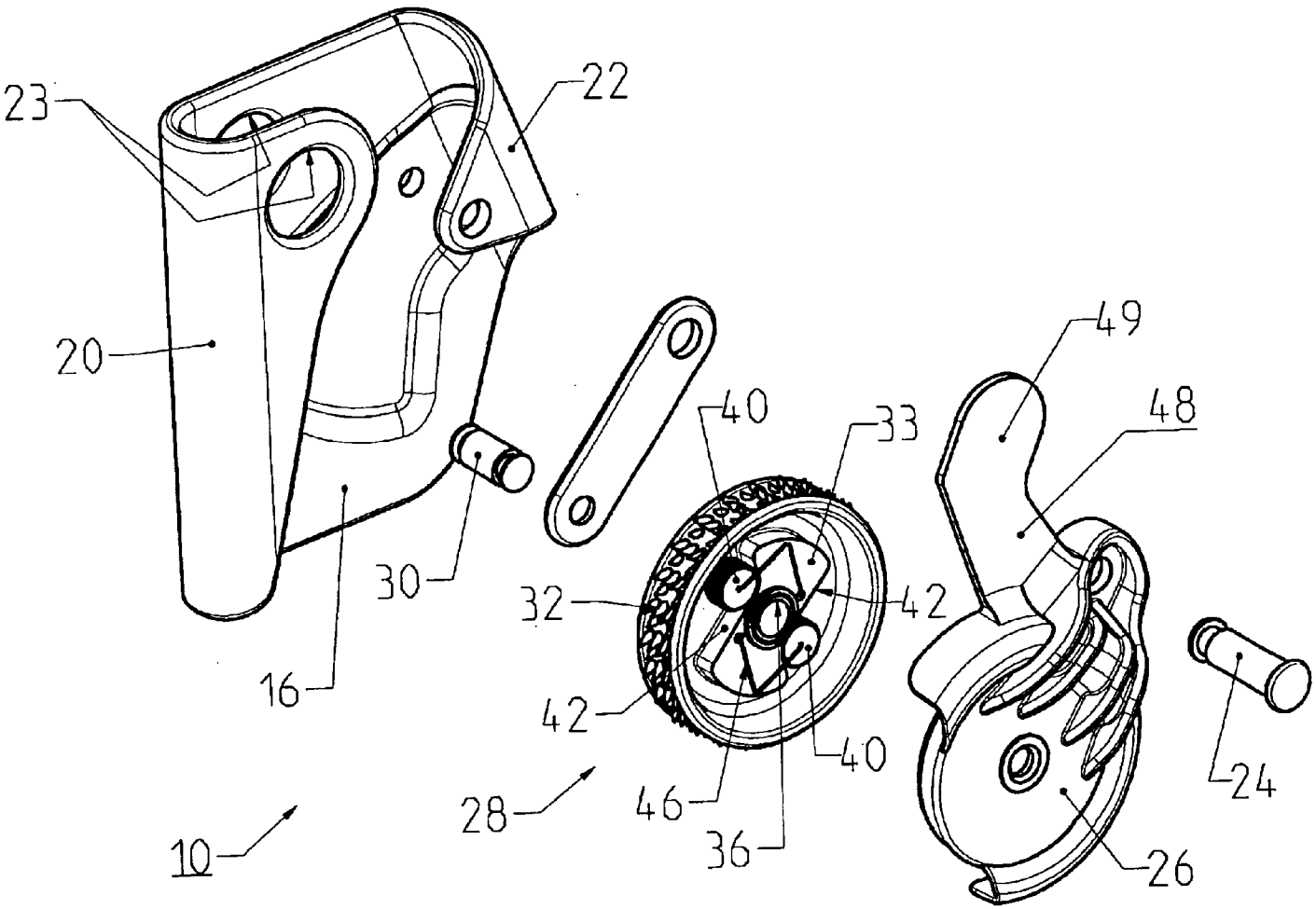
FIG. 2 shows an exploded perspective view of the fall arrest device of FIG. 1, the clutch mechanism being shown in the disengaged position inside the roller.
Figure 3:
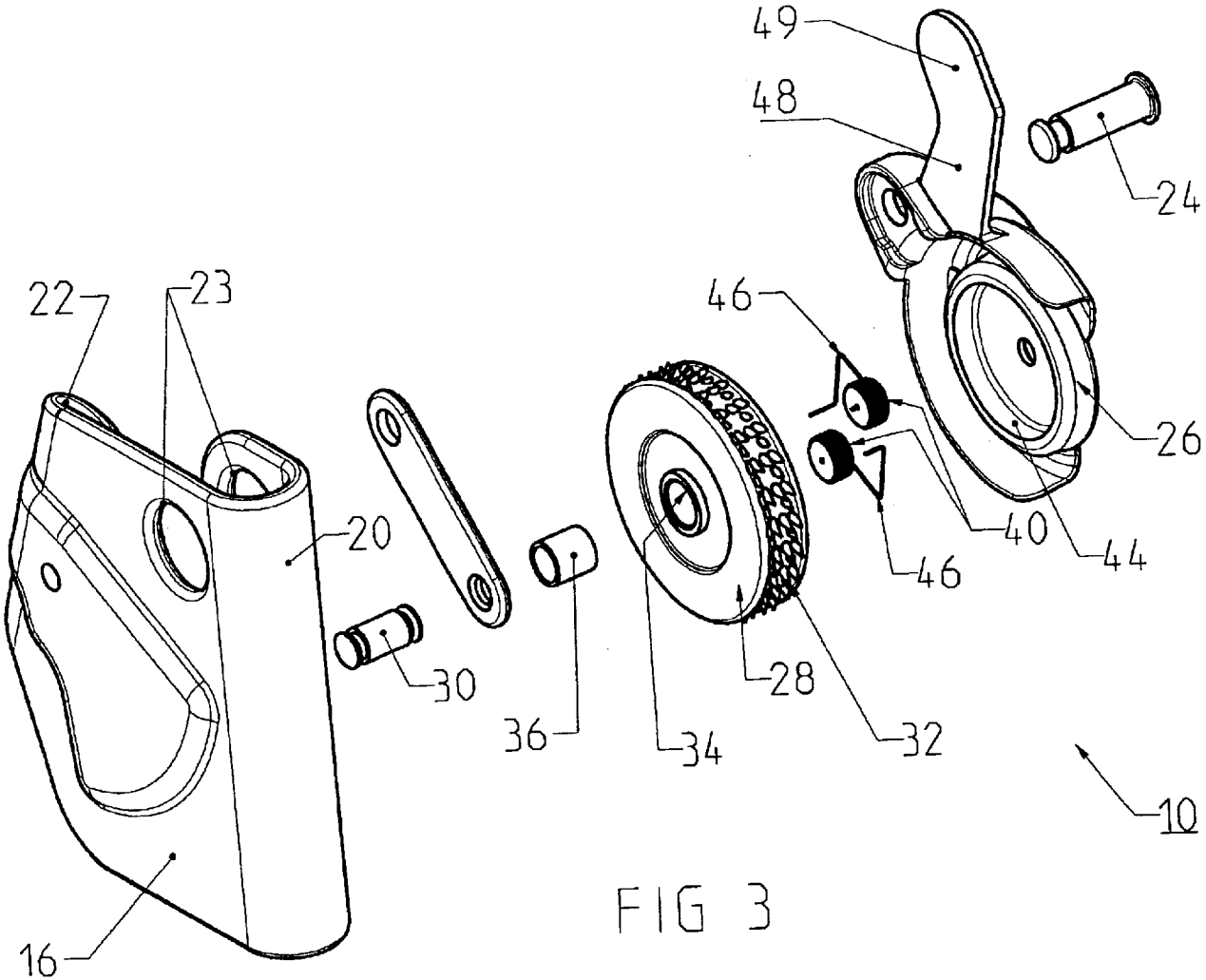
FIG. 3 is a left-hand view of FIG. 2, after the flyweights have been disassembled.
Figure 4:
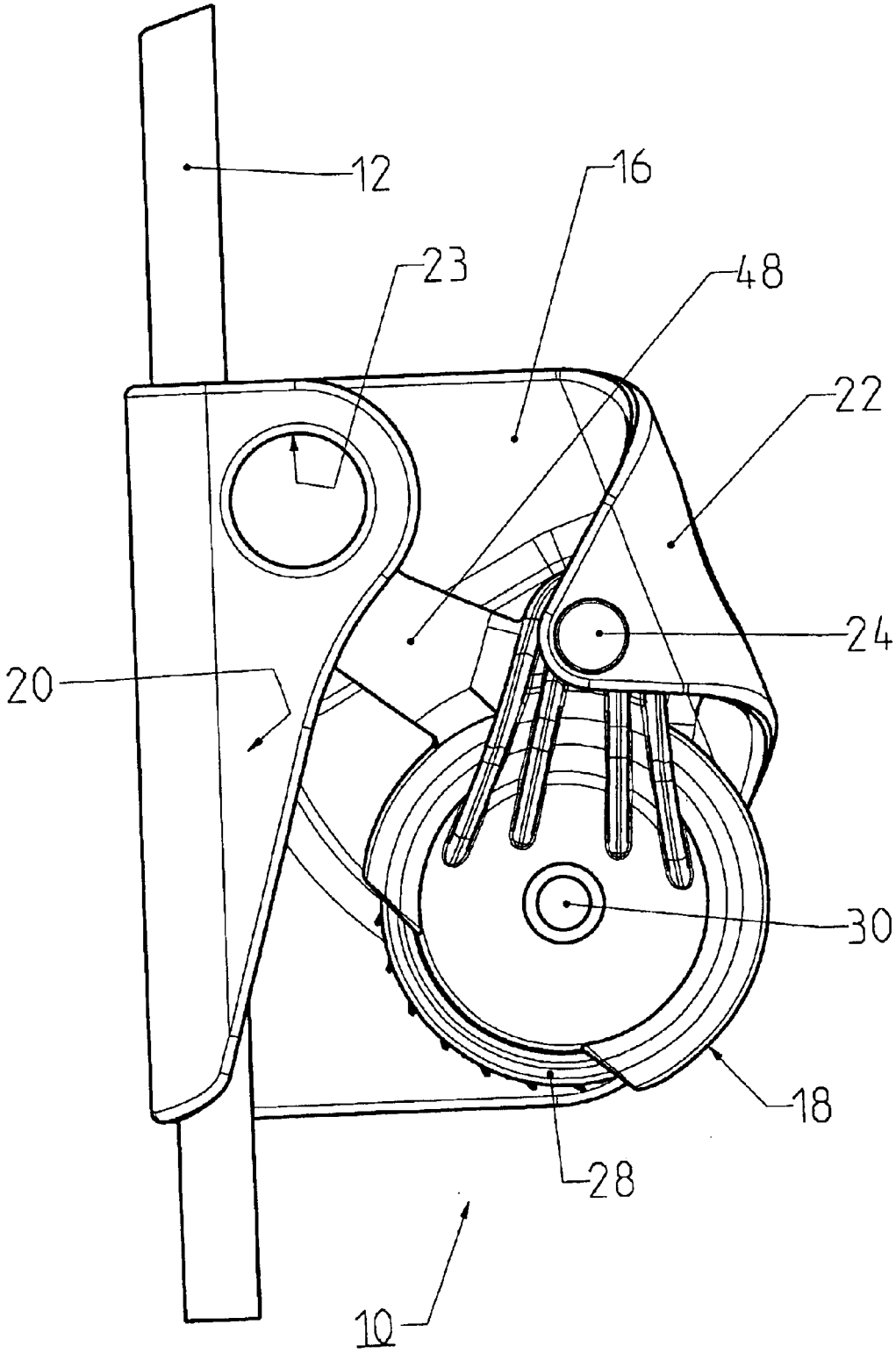
FIG. 4 represents an elevational view of the device after the securing system has been opened to fit the rope.

In FIGS. 1 to 12, a fall arrest device 10 is used for the safety of a person moving along a fixed belaying rope 12. A karabiner 14 is latched onto the fall arrest device 10 so as to be connected to the body harness, either directly or via an absorption lanyard.

In normal use for ascending or descending, the fall arrest device 10 follows the progression of the person along the rope 12 without causing locking. The person is free to move without any manual unlocking action of the fall arrest device 10.

The fall arrest device 10 is composed of a rigid body 16 and a movable securing system 18 cooperating with the rope 12 to occupy either an active locking position in case of a fall, or an inactive unlocking position in the ascending direction, or in the opposite direction during a controlled descent.

The preferably metal body 16 comprises a straight U-shaped channel 20 for passage of the rope 12, and a bracket 22 for fitting a first spindle 24 extending transversely with respect to the direction of the channel 20. Two holes 23 are drilled in the upper part of the channel 20 to allow the attachment karabiner 14 of the harness to pass.

The securing means 18 comprise a support arm 26 articulated on the first spindle 24, and a roller 28 in the form of a wheel mounted with free rotation on a second spindle 30 securedly attached to the support arm 26. The peripheral surface of the roller 28 is cylindrical and is equipped with a plurality of studs 32 each having a predetermined angle of incline with respect to the radial direction passing through the spindle 30. A tension spring (not shown) is threaded onto the first spindle 24 and biases the support arm 26 in the direction of the channel 20.

The roller 28 is equipped with an internal drive member 33, wherein there is drilled a central cylindrical hole 34, through which hole there passes a tubular bearing 36 fitted on the second fixed spindle 30. Inside the roller 28 there is housed in addition a clutch mechanism 38 formed by a pair of cylindrical flyweights 40 arranged between opposite ramps 42 of the drive member 33 and a circular rim 44 of the support arm 26.

To each flyweight 40 there is associated a spring 46 in the form of a pin designed to urge the clutch mechanism 38 to the disengaged position in normal use of the fall arrest device 10. In this rest state, the flyweights 40 are located in a recess of the drive member 33 so as to interrupt the mechanical coupling 38 between the roller 28 and support arm 26. The roller 28 is then driven in rotation by friction of the rope 12 whereas the support arm 26 is in the inactive position enabling the fall arrest device 10 to follow the ascending or descending progression of the user.

The return force of the springs 46 defines the coupling threshold according to the speed or the acceleration of the drive member 33 of the rotary roller 28. In the event of a fall, sudden rotation of the roller 28 on the spindle 30 causes the flyweights 40 to move by centrifugal effect to the disengaged position. This movement takes place against the return force of the springs 46 and causes jamming of the flyweights 40 against the rim 44 and drive member 33. The clutch mechanism in the engaged position thus secures the roller 28 to the support arm 26 so as to form a jamming cleat able to pivot around the first spindle 24 and to arrest the fall by jamming the rope 12.

The pivoting support arm 26 is equipped with a stop 48 designed to cooperate with the karabiner 14 to limit the pivoting travel of the arm 26 in the inactive unlocking position. The response time of the pivoting support arm 26 is thus reduced to the minimum to achieve locking in case of a fall. The end of the stop 48 is provided with a protuberance 49 designed to fit between the two holes 23 of the body 16 to prevent the karabiner 14 from being fitted before the rope 12 has been inserted.

Operation of the fall arrest device 10 according to FIGS. 1 to 12 is as follows:

In FIGS. 1 to 12, the fall arrest device 10 is represented in the open position to fit the rope 12 in the channel 20. The securing system 18 is fully separated from the channel against the return force of the tension spring. The rope 12 is anchored to a fixed higher point, for example a plate or peg. The protuberance 49 of the stop 48 blanks off the two holes 23, which prevents the karabiner 14 from being fitted before the rope 12 has been inserted in the channel 20.

Figure 5:
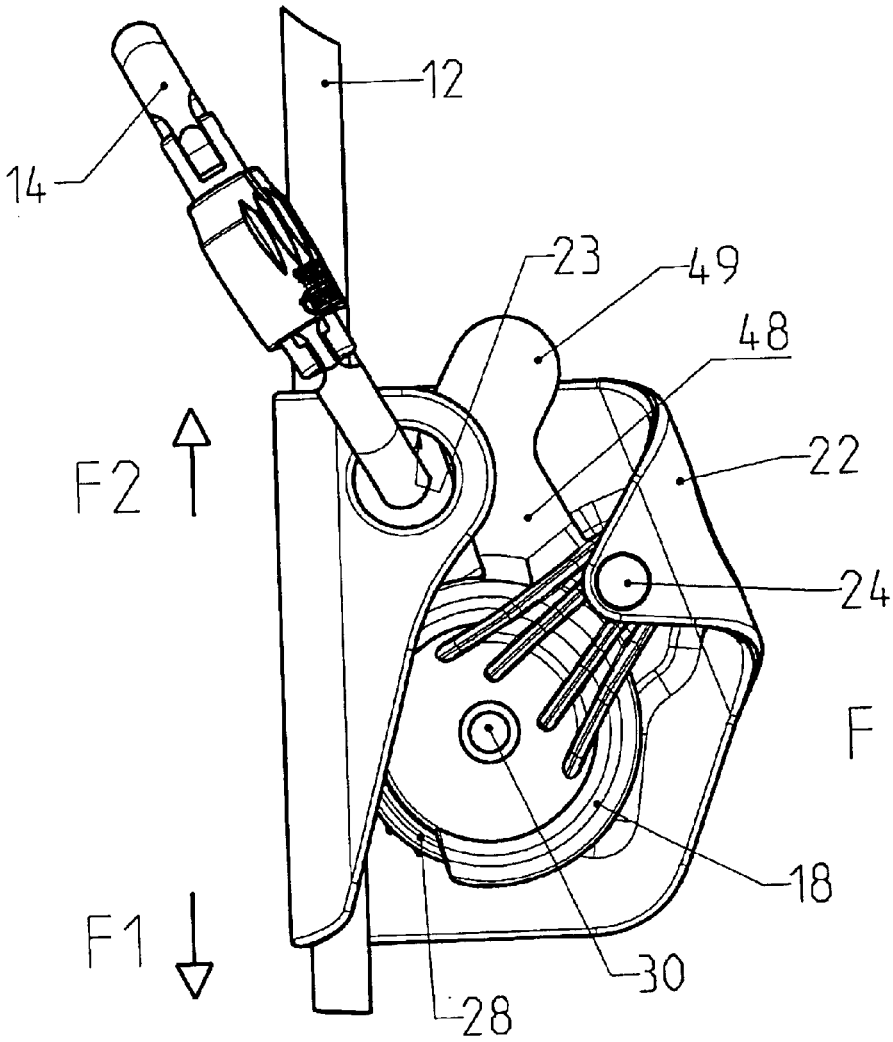
FIG. 5 is an identical view to FIG. 4 and represents the position of normal use for ascending and descending after the karabiner has been fitted.
Figure 6:
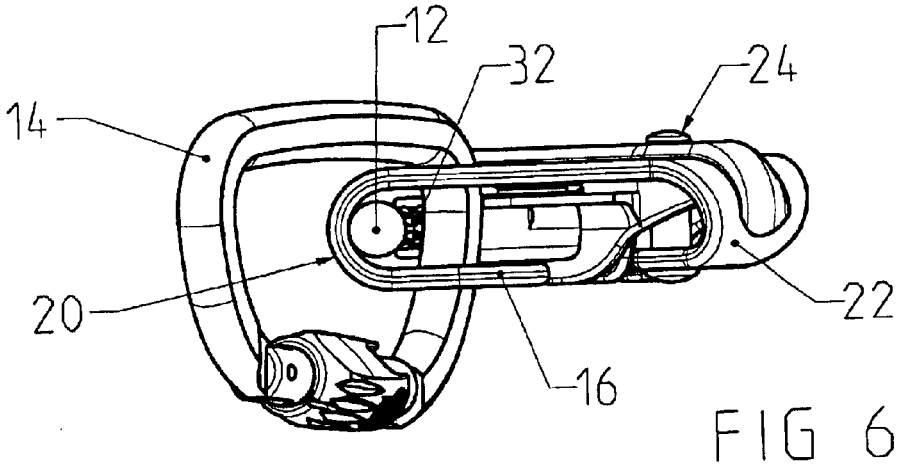
FIG. 6 is a top view of FIG. 5.
Figure 7:
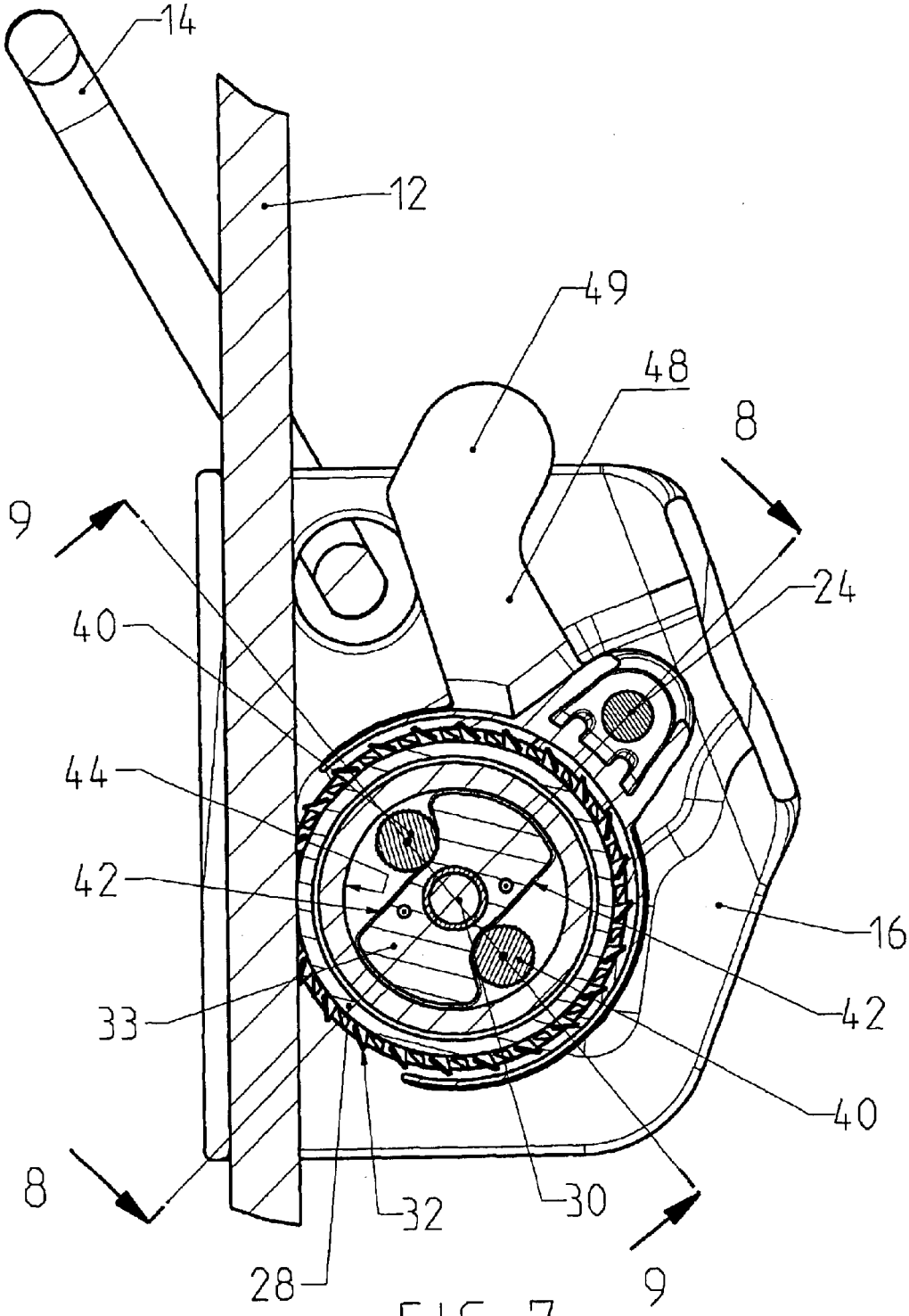
FIG. 7 is a vertical sectional view of FIG. 5.
Figure 8:
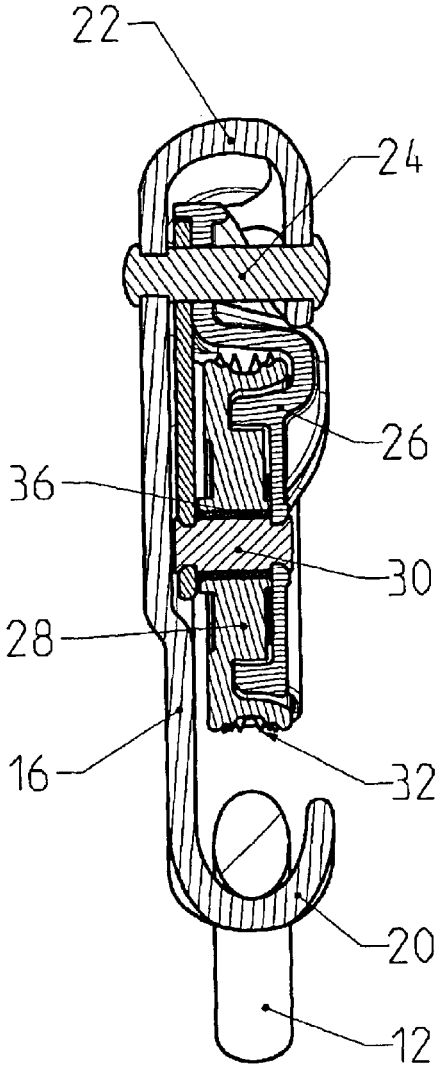
FIGS. 8 and 9 are sectional views along the lines 8—8 and 9—9 of FIG. 7.
Figure 9:
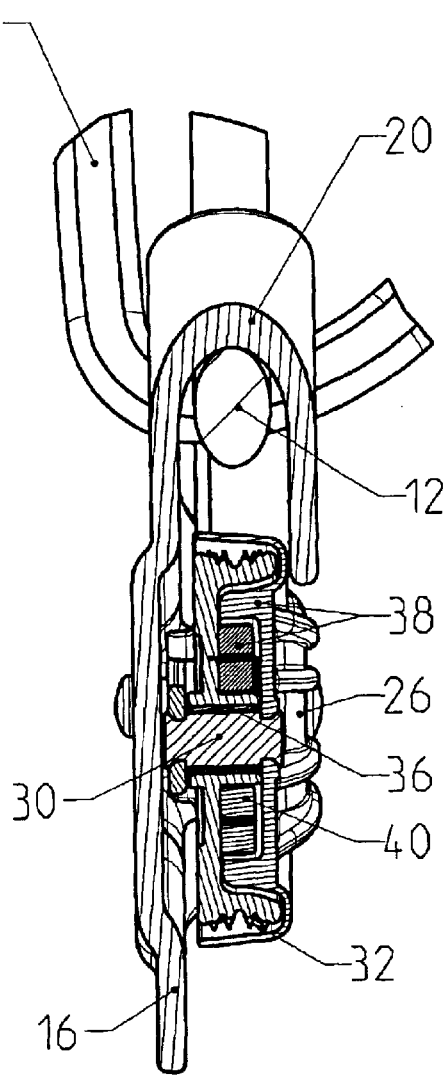

In FIGS. 5 to 7, the position of normal use of the fall arrest device 10 for ascending (arrow F1) or descending (arrow F2) is achieved after the securing system 18 has been released and the karabiner 14 has been fitted in the holes 23. The studs 32 of the roller 28 come into contact with the rope 12 due to the action of the tension spring, but without causing locking. The fall arrest device 10 follows the progression of the person along the rope 12, the clutch mechanism 38 being continuously in the disengaged position. The person is free to move without any manual unlocking action of the fall arrest device 10. When descending (arrow F2), the roller 28 rotates clockwise due to the friction effect of the rope 12 on the studs 32, and the flyweights 40 remain immobilized in the disengaged position due to the action of the springs 46. Controlled braking of the roller 28 enables the fall arrest device 10 to be positioned above the user. When ascending (arrow F1), the roller 28 slides on the rope 12 due to the assembly formed by the arm 29 and roller 28 pivoting around the first spindle 24.

Figure 10:
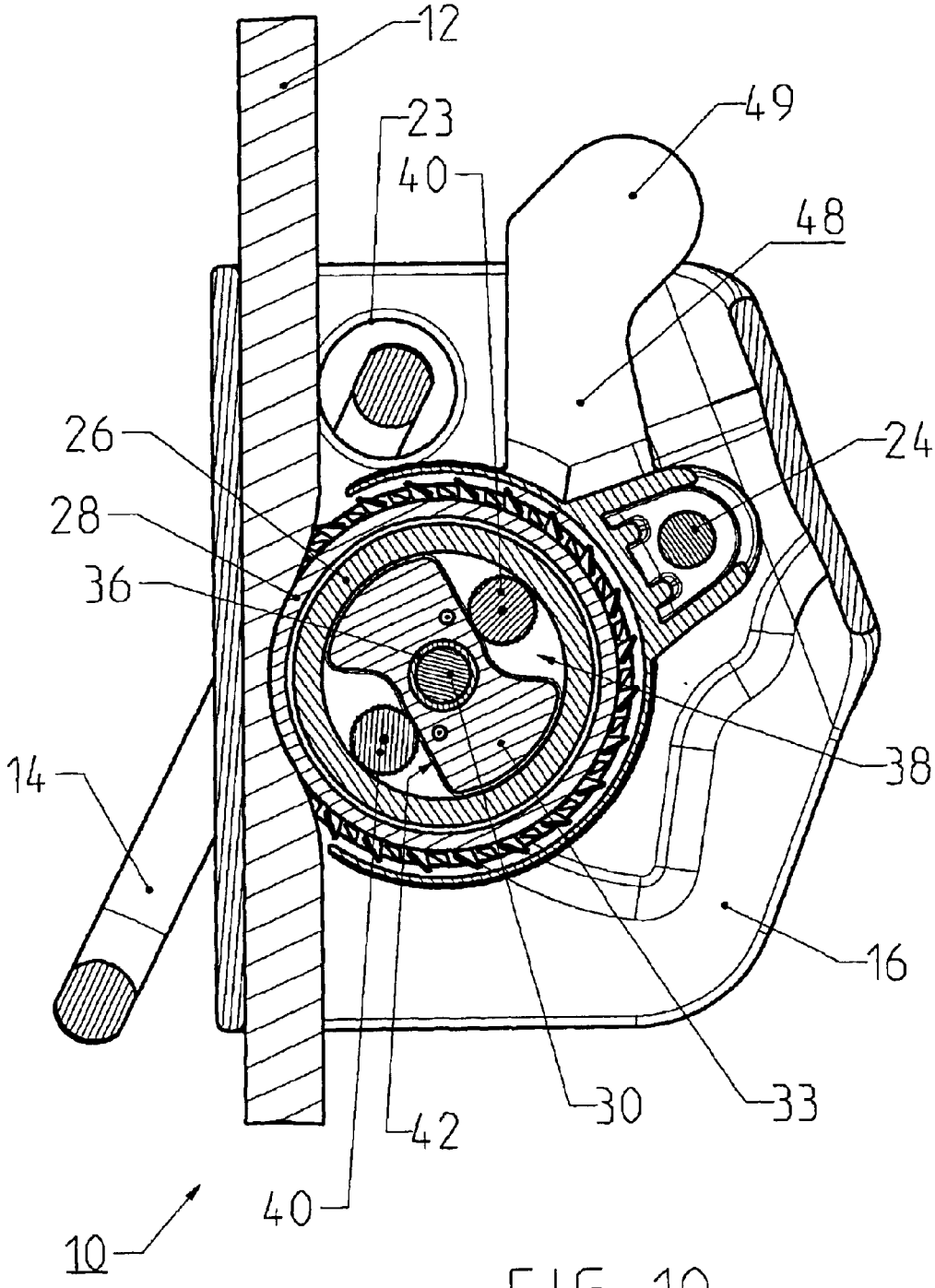
FIG. 10 shows an identical view to FIG. 7, the device being in the locked position following a fall.

With reference to FIG. 10 corresponding to a locking position on a fall of the user, the sudden rotation of the roller and drive member 33 in the clockwise direction subjects the flyweights 40 to a centrifugal force which is greater and in the opposite direction to the return force of the springs 46. The flyweights 40 move on the ramps 42, which causes jamming of the flyweights 40 between the rim 44 and the drive member 33. The coupling mechanism is then in the engaged position securedly attaching the roller 28 to the support arm 26. The assembly constitutes a jamming cleat able to pivot clockwise around the first spindle 24 and to arrest the fall by locking the rope 12. Unlocking of the flyweights 40 is performed by manual action of the operator consisting in holding the roller 28 against the rope 12 and moving the body 16 up a few centimetres.

Figure 11:
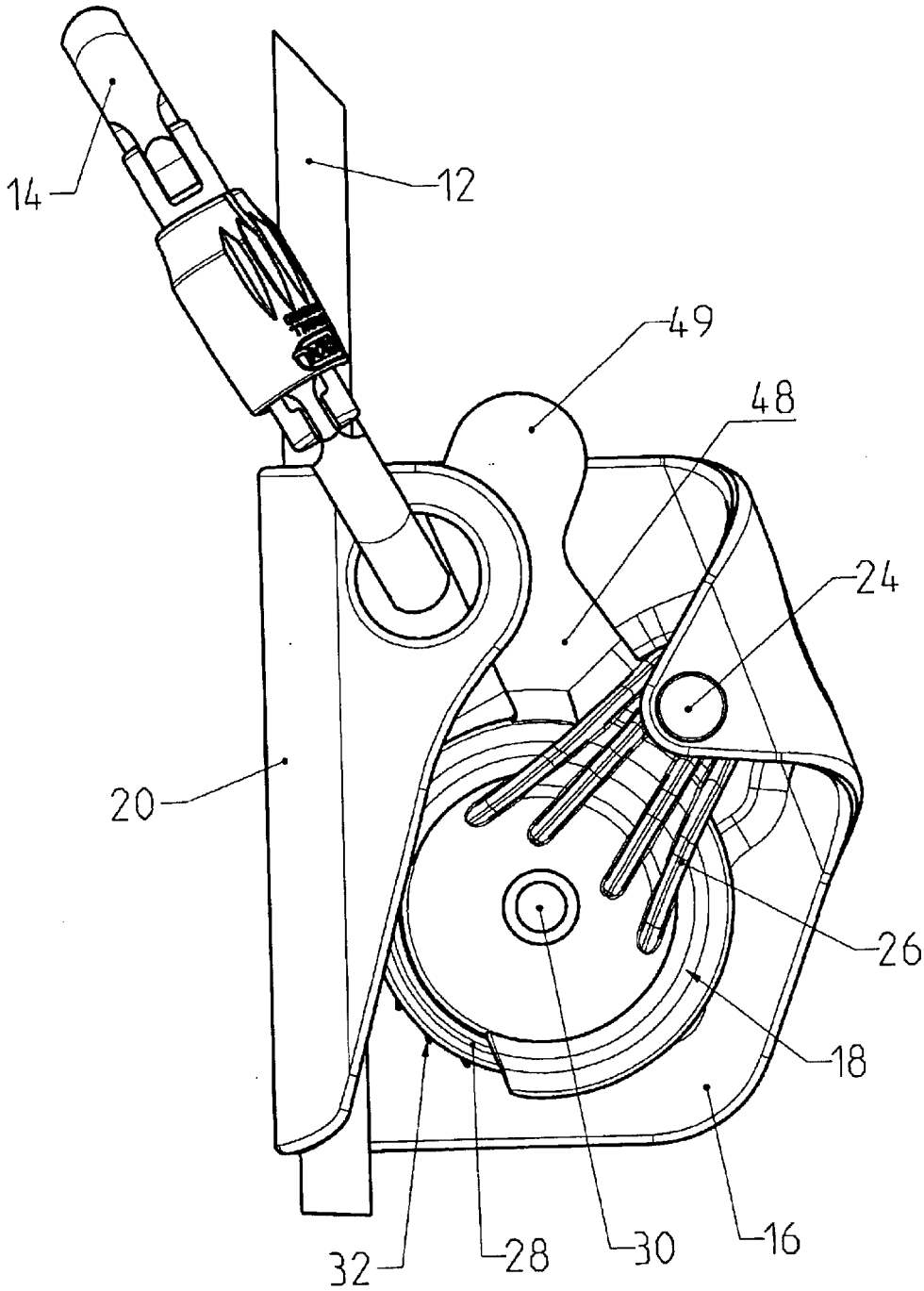
FIG. 11 shows the opening-prevention safety position after the securing system has come up against the stop formed by the karabiner.
Figure 12:
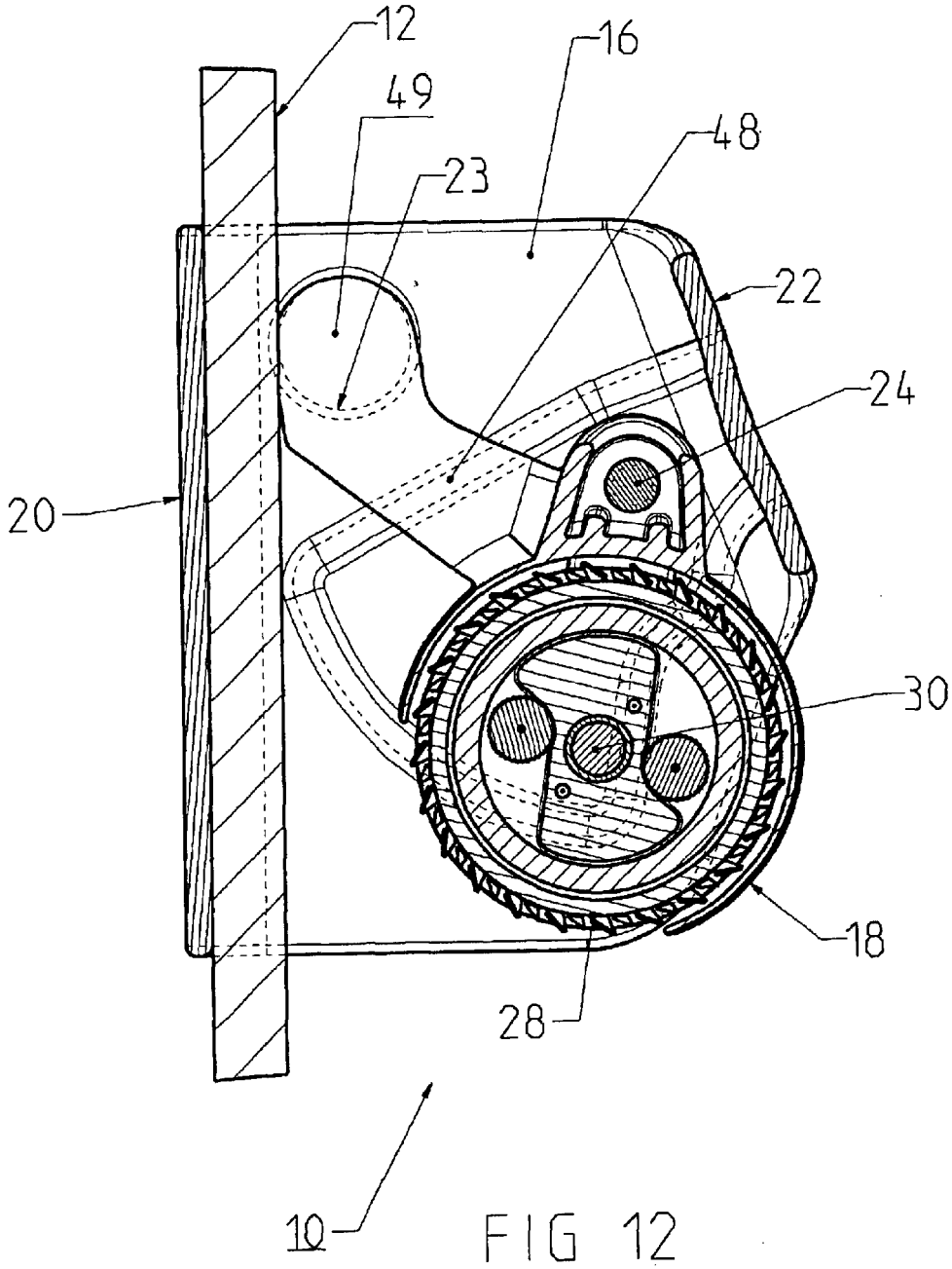
FIG. 12 is a sectional view of FIG. 4, the stop being in a position preventing the karabiner from being fitted.
Figure 13:
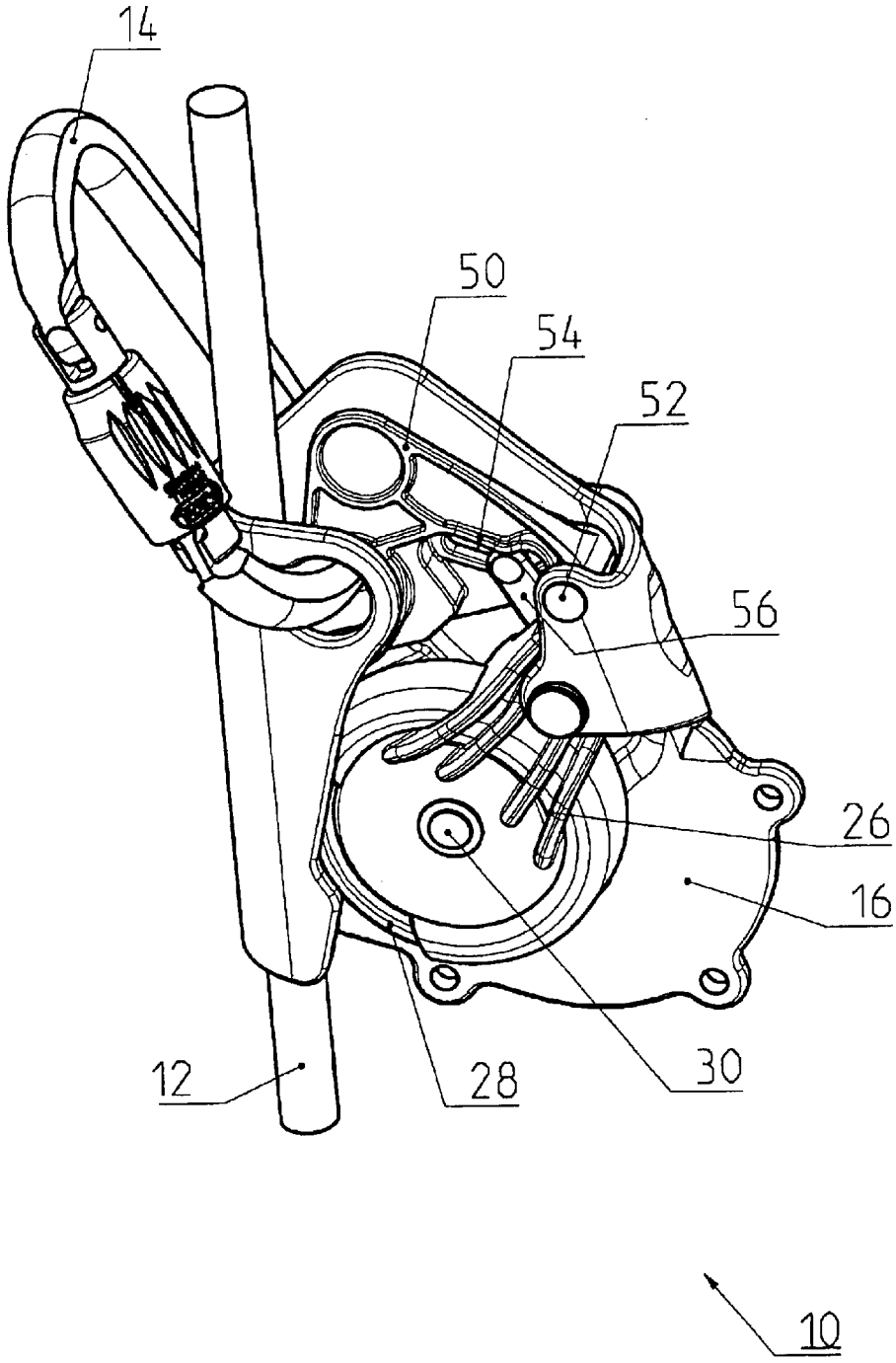
FIG. 13 is a perspective view of an alternative embodiment with a safety flap.

In FIG. 11, it can be observed that in the normal position of use of the fall arrest device 10, the stop 48 is pressing against the karabiner 14 to limit the pivoting travel of the arm 26 in the inactive unlocking position. The response time for locking is thus reduced in case of a fall.

According to the development of the invention illustrated in FIGS. 13 to 17, the stop 48 is replaced by a safety flap 50 which is arranged to perform the same functions as the stop 48 of the foregoing FIGS. 1–12, with in addition a function of positioning the rope 12 in the bottom of the channel 20 before the karabiner 14 is inserted in the holes 23.

The safety flap 50 is pivotally mounted on a spindle 52 and comprises an oblong opening 54 inside which an operating lever 56 moves securedly attached to the support arm 26. The opening 54 presents a double jointed ramp designed to move the flap 50 according to the pivoting movement of the arm 26. The flap 50 in addition comprises a wing 58 designed to press the rope 12 against the bottom of the channel 20.

Figure 14:
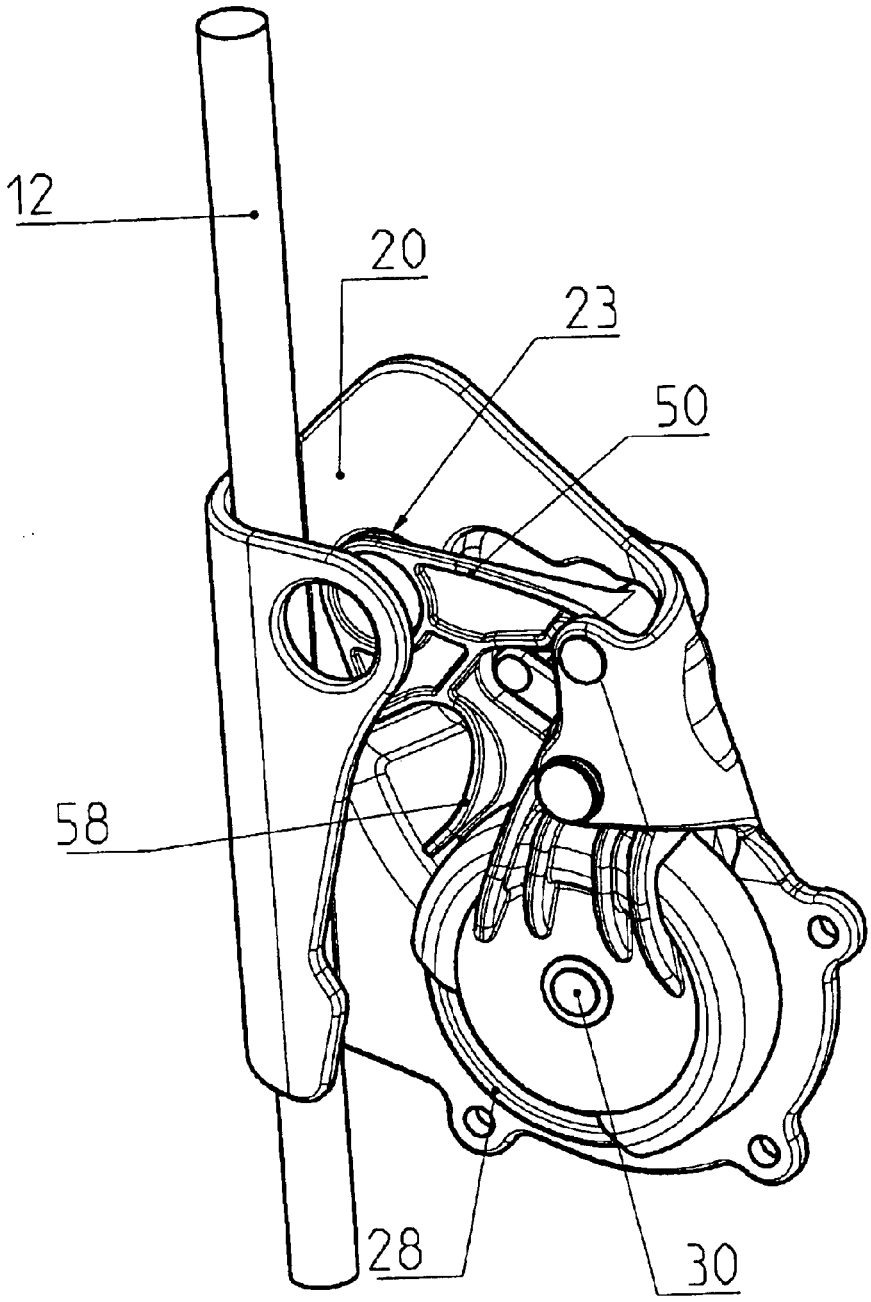
FIG. 14 is an identical view to FIG. 13 when opening of the support arm takes place to fit the rope.

Operation of the safety flap 50 according to FIGS. 14 to 17 is as follows:

In FIG. 14 corresponding to fitting of the rope 12, the support arm 26 of the fall arrest device 10 is in the open position and the flap 50, driven by the operating lever 56, blanks off one of the holes 23. In this position, the karabiner 14 can not be inserted in the holes 23, and the passage of the rope 12 in the channel 20 is cleared.

Figure 15:
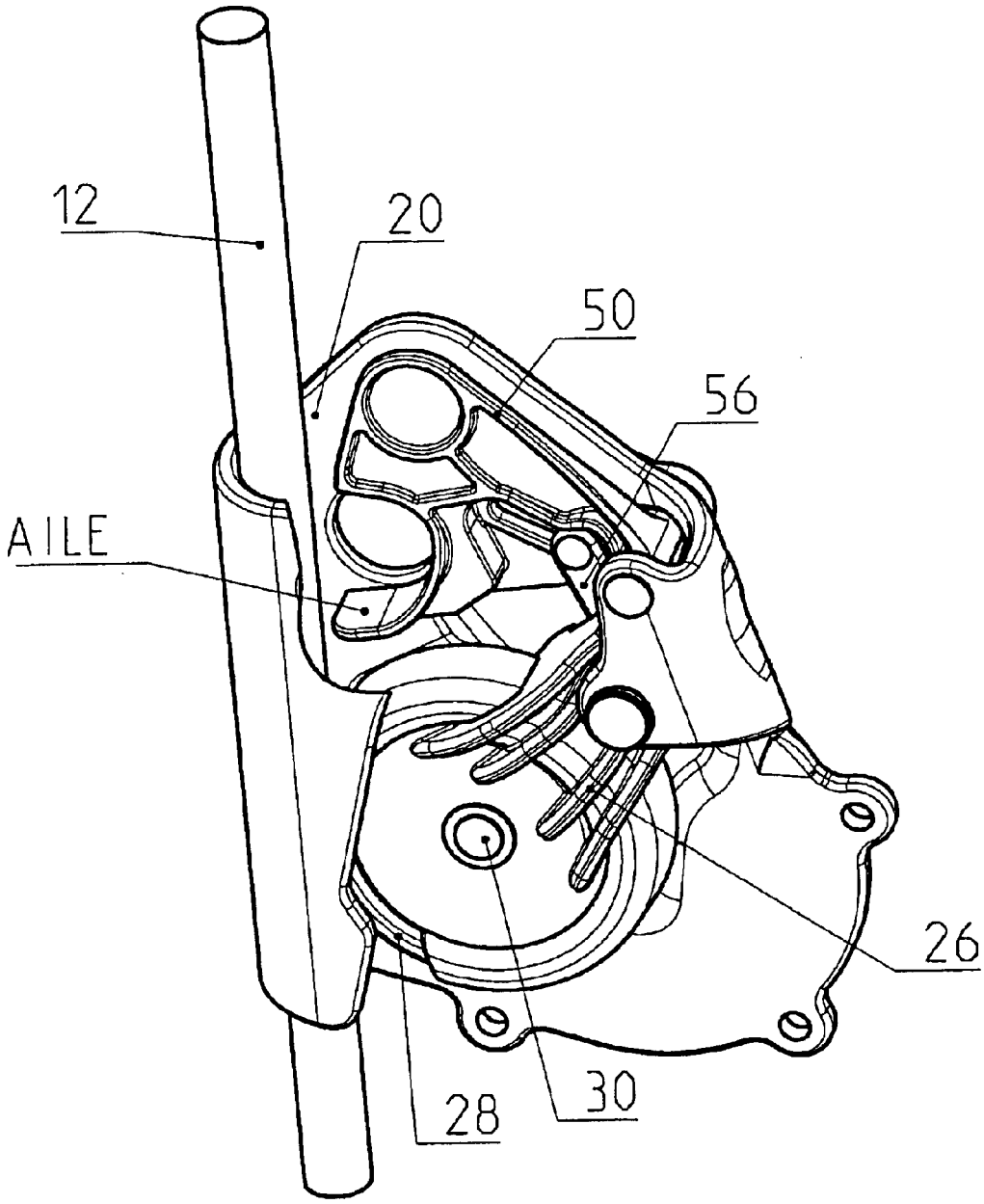
FIGS. 15 to 17 are partially cutaway views of FIG. 13, respectively after the rope has been fitted, in normal operating position, and in the locking position.
Figure 16:
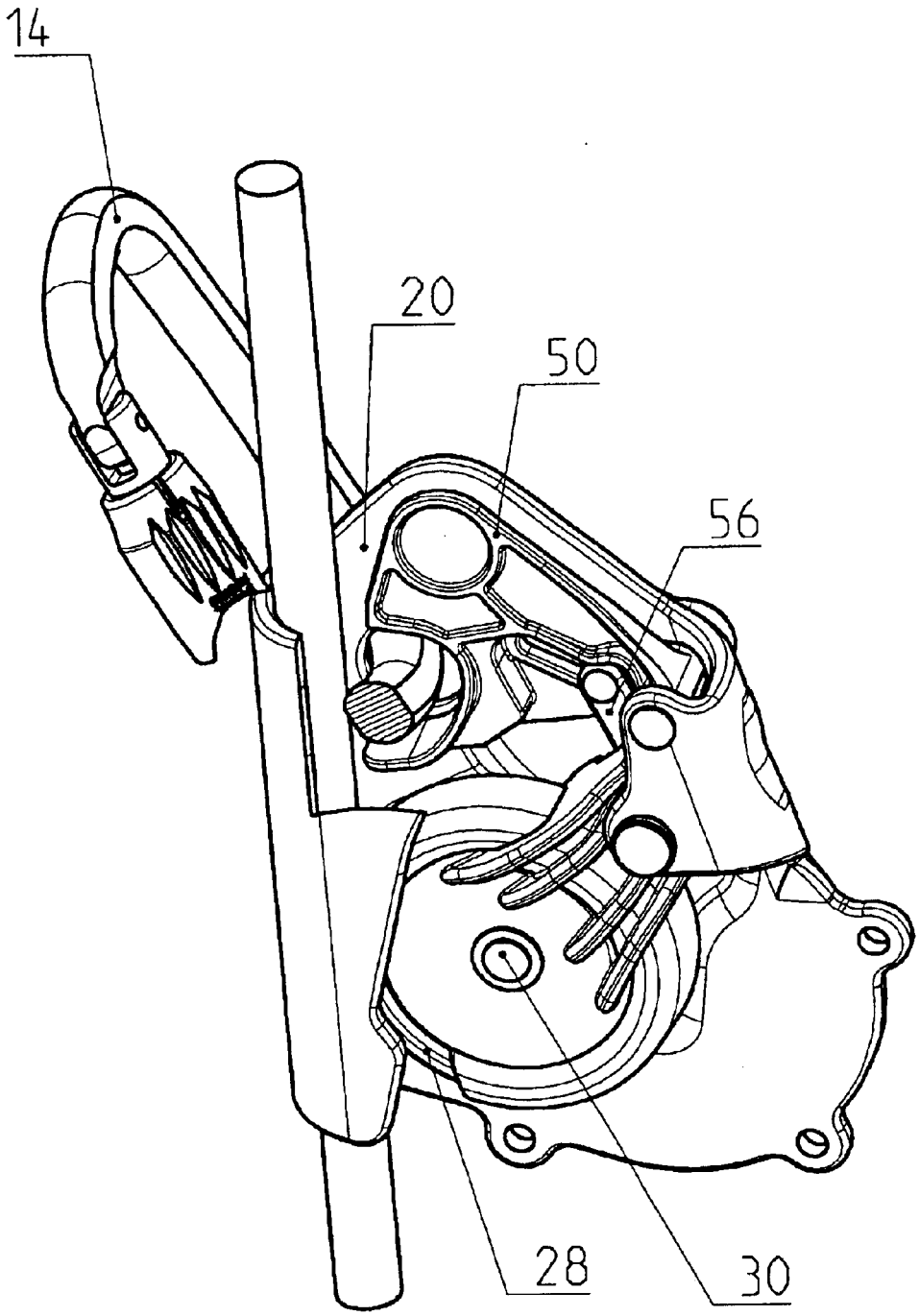

In FIGS. 15 and 16, the operator releases the pivoting arm 26 after the rope 12 has been inserted in the channel 20. The wing 56 of the flap 50 positions the rope 12 correctly at the bottom of the channel 20. The separation of the flap 50 thus enables the karabiner 14 to be inserted in the holes 23 and the rope 12 is positioned between the channel 20 and karabiner 14 in the normal operating position.

Figure 17:
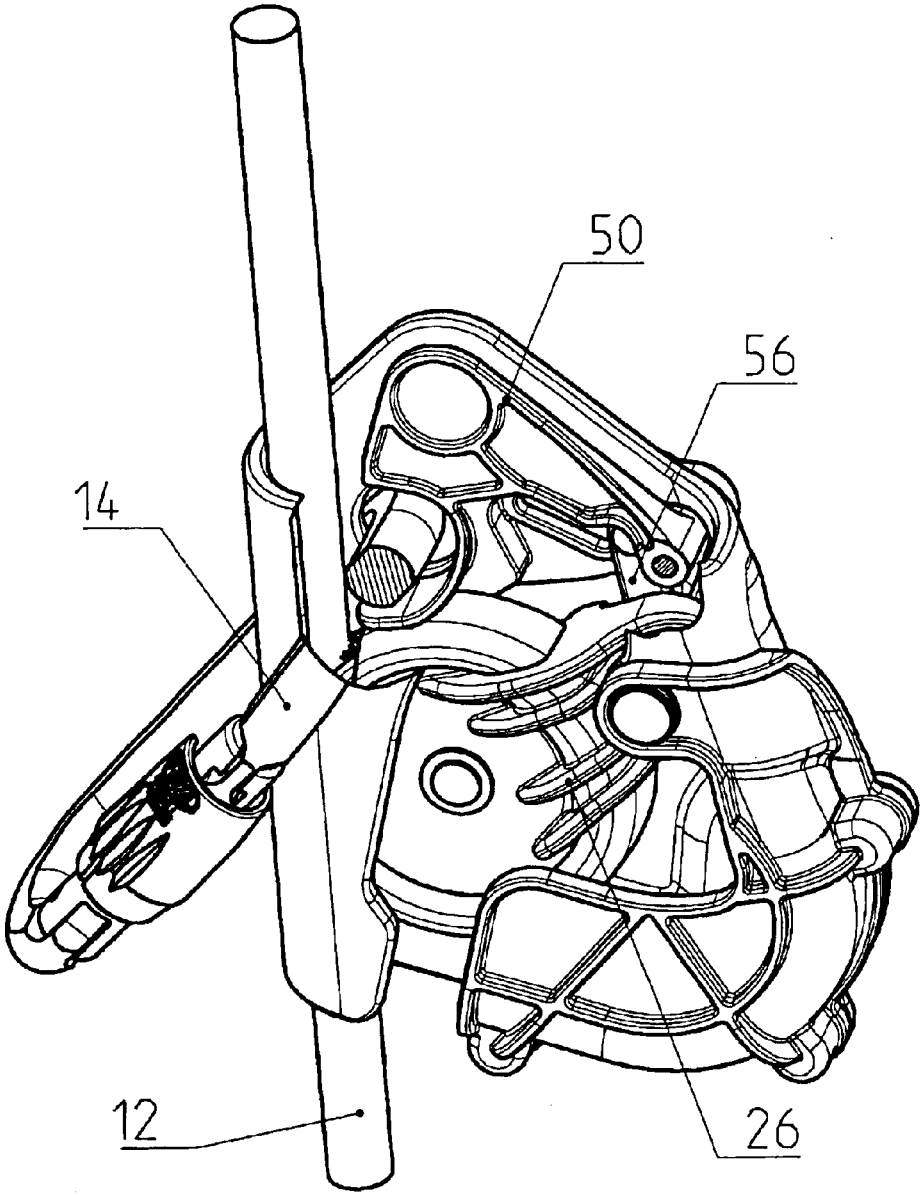

In FIG. 17 corresponding to the unlocking position of the arm 26 following a fall, the movement of the lever 56 in the opening 54 enables the flap 50 to keep the same position as in FIG. 16, so as not to interfere with the locking kinematics.

What is claimed is:

1. A follower fall arrest device used with a fixed safety rope, and comprising:

a body equipped with a securing system arranged to occupy either an active locking position in case of a fall or an inactive unlocking position enabling the user to progress along the rope in the ascending direction, or in the opposite direction when performing a controlled descent, said securing system comprising a support arm articulated on a first spindle of the body, a roller in the form of a cylindrical wheel mounted rotating free on a second spindle securedly attached to the support arm, and a centrifugal clutch mechanism arranged between a drive member of the roller and the support arm so as to occupy a disengaged position or an engaged position, and attachment means for connecting the body to a safety harness worn by the user, wherein the peripheral surface of the roller is equipped with a plurality of studs arranged to cause rotation of the roller in the descending direction, and sliding on the rope in the ascending direction, the body comprises a straight U-shaped channel for passage of the rope, said channel having holes for passage of the attachment means, and the support arm is equipped with safety means designed to limit the pivoting travel of said arm in the inactive unlocking position and to prevent the karabiner from being fitted before the rope has been inserted in the channel.

2. The fall arrest device according to claim 1, wherein the clutch mechanism is arranged inside the roller and comprises at least one flyweight movable by centrifugal effect along a ramp according to the speed or the acceleration of the drive member of the roller.

3. The fall arrest device according to claim 2, wherein the flyweight is associated with a return spring urging the clutch mechanism to the disengaged position, the coupling threshold being reached when the centrifugal force is greater than the return force of the spring.

4. The fall arrest device according to claim 3, wherein the flyweight is cylindrical in shape and cooperates in the engaged position with a cylindrical rim of the support arm.

5. The fall arrest device according to claim 1, wherein the attachment means are formed by a karabiner passing through the holes of the body.

6. The fall arrest device according to claim 1, wherein the safety means comprise a stop securedly attached to the support arm and having one end equipped with a protuberance.

7. The fall arrest device according to claim 1, wherein the safety means comprise a flap pivotally mounted on a spindle and comprising:

an oblong opening inside which an operating lever securedly attached to the support arm moves, and a wing designed to press the rope against the bottom of the channel.

* * * * *